United States Patent [19]

Mitchell, Jr. et al.

[11] Patent Number: 4,495,867

[45] Date of Patent: Jan. 29, 1985

[54] ASSEMBLY FOR INITIATING EXPLOSIVES WITH LOW-ENERGY DETONATING CORD

[75] Inventors: Hardin D. Mitchell, Jr., Monument, Colo.; Malak E. Yunan, Boonton Township, Morris County, N.J.

[73] Assignee: E. I. Du Pont de Nemours and Company, Wilmington, Del.

[21] Appl. No.: 389,621

[22] Filed: Jun. 18, 1982

[51] Int. Cl.[3] ..... C06C 5/00

[52] U.S. Cl. ..... 102/275.4; 102/275.7

[58] Field of Search ..... 102/275.2, 275.3, 275.4, 102/275.5, 275.6, 275.7, 275.8, 275.11, 275.12, 204, 200

[56] References Cited

U.S. PATENT DOCUMENTS

| | | | |
|---|---|---|---|
| Re. 20,190 | 12/1936 | Lewis | 102/275.4 X |
| 2,253,549 | 8/1941 | Barton | 102/275.12 X |
| 2,545,380 | 3/1951 | Poulter | 181/109 |
| 2,706,011 | 4/1955 | Bayhi | 181/107 |
| 2,952,206 | 9/1960 | Beckstead | 102/275.7 |
| 3,020,844 | 2/1962 | Miller | 102/275.4 |
| 3,041,914 | 7/1962 | Garton et al. | 102/275.3 X |
| 3,062,313 | 11/1962 | Coursen et al. | 181/112 |
| 3,205,818 | 9/1965 | Coulson | 102/275.4 |
| 3,729,060 | 4/1973 | Murray | 181/116 |
| 3,878,785 | 4/1975 | Lundberg | 102/275.4 |
| 4,248,152 | 2/1981 | Yunan | 102/275.4 |
| 4,335,652 | 6/1982 | Bryan | 102/275.3 X |
| 4,350,097 | 9/1982 | Bowman et al. | 102/275.3 X |

FOREIGN PATENT DOCUMENTS

| | | | |
|---|---|---|---|
| 521014 | 5/1940 | United Kingdom | 102/275.12 |
| 1248432 | 10/1971 | United Kingdom . | |

OTHER PUBLICATIONS

"Du Pont Magazine" Jan./Feb. 1983, vol. 77, No. 1, pp. 6–9.

*Primary Examiner*—David H. Brown

[57] ABSTRACT

An assembly for initiating a detonating explosive charge, e.g., a surface seismic charge, by low-energy detonating cord (LEDC) has a cord-connector fitted around a percussion-actuated detonator or booster, and a means of piercing a frangible package to enable the assembly to be embedded in the charge. In a preferred assembly, the connector is a plastic tube which fits over the actuation end of a booster shell whose opposite end is notched or serrated. A detonator preferably is fitted in a plastic cord-connecting tube whose end surface is tapered, or which has a pointed extension member, forming a spike. LEDC does not pose the fire hazard encountered with heavier cords in surface seismic operations in wooded or grassy areas.

33 Claims, 15 Drawing Figures

ASSEMBLY FOR INITIATING EXPLOSIVES WITH LOW-ENERGY DETONATING CORD

BACKGROUND OF THE INVENTION

1. Field of the Invention

The present invention relates to an assembly for initiating a charge of detonating explosive in a frangible package, e.g., a cartridge or bag made of plastic film, by means of a length of low-energy detonating cord, and to a surface seismic prospecting assembly wherein a number of such charges are initiated by a single length of detonating cord.

2. Description of the Prior Art

A technique of surface seismic exploration employing arrays of elevated explosive charges is described in U.S. Pat. No. 2,545,380. In one mode of operation, film-packaged explosives are used as surface seismic charges, and these are initiated nonelectrically, by use of high-energy detonating cord having a core explosive load of about from 5 to 13 grams per meter. The practice has been to suspend the cartridged or bagged explosive on wooden stakes sufficiently high off the ground to prevent fires. In certain cases, the detonating cord is wrapped around the bag of explosive, thereby serving as a means of attaching the bag to the stake as well as a means of initiating the detonation of the seismic charge.

The high core loadings of the detonating cords heretofore used to obtain reliable initiation of certain seismic explosives, especially in cold weather, unfortunately pose a fire hazard, especially in wooded or grassy areas. Confinement of the explosive core within a sheath of salt has been tried in an effort to confine the cord fire, but the degree of reliability of the initiation of the seismic charges with this salt-sheathed cord, especially in cold weather, has been unsatisfactory, and the fire hazard not eradicated completely.

Another factor in this system which affects the reliability of initiation of the charges derives from the means by which the cord is attached thereto. Failures can occur if a poorly secured knot should cause loss of contact between the seismic charge and the cord, or if the detonation of a given segment of cord should be cut off by the detonation of an adjacent crossed-over segment positioned there during the wrapping of the cord around the charge.

Accordingly, a means is needed for initiating cartridged seismic explosive charges by means of detonating cord which does not introduce a fire hazard, allows an easily accomplished and secure attachment of the cord to the charges in the field, and affords a high degree of reliability with respect to the initiation of the charges.

SUMMARY OF THE INVENTION

The present invention provides an assembly for use in combination with a low-energy detonating cord (LEDC) and a charge of detonating explosive, e.g., a water gel explosive, in a frangible package for the transmission of a detonation impulse from the cord to the charge of detonating explosive, which assembly comprises:

(a) a percussion-actuated explosive initiator, e.g., a detonator (blasting cap) or an explosive booster, comprising a tubular shell containing a percussion-sensitive composition at the actuation end thereof;

(b) connecting means fitted around at least a portion of the initiator shell, e.g., a connecting tube or tubular end-sleeve, for attaching the initiator to a length of LEDC and for holding the cord transversely adjacent the actuation end of the initiator shell; and (c) means on, in, or integral with the initiator shell or connecting means, for piercing a frangible package containing a detonating explosive and enabling the initiator to be embedded in the explosive.

A preferred connecting means for use in the assembly is a plastic tube having two diametrically opposed, mutually conformed openings in its wall which together form a transverse slot communicating with the tube's bore and adapted to transversely engage a length of LEDC, the wall of said tube being slit longitudinally at two diametrically opposed locations from said openings to one end of said tube, said two longitudinal slits lying in a plane that passes through the longitudinal axis of said tube and together forming an axial, constricted transverse passage between said slot and said tube end, said passage being adapted to allow a length of LEDC to be pushed into, while hindering its disengagement from, said slot, and said openings being so configured that a length of LEDC transversely engaged in said slot is diverted from the axis of said constricted passage.

In still another preferred embodiment, the connecting means is a plastic tube having a cord-engaging transverse slot near one end, and a taper or extension member which forms a package-piercing spike at the opposite end.

In another preferred embodiment, the initiator is a booster whose metal shell has an integrally closed actuation end, an internal plug for sealing the explosive charge off from the atmosphere, and an open end-surface which is jagged, e.g., tapered, serrated, or notched, for package-piercing purposes.

This invention also provides an explosives assembly, particularly a surface seismic prospecting assembly, comprising two or more charges of detonating explosive in frangible packages, preferably supported above the ground, with an initiation assembly of the invention embedded in each charge and a length of LEDC held transversely adjacent the actuation ends of the initiators in the initiation assemblies.

BRIEF DESCRIPTION OF THE DRAWING

In the accompanying drawing, which illustrates specific embodiments of the initiation assembly of the invention, and of its use in an assembly for seismic prospecting wherein a number of seismic charges are initiated by a common length of detonating cord.

DETAILED DESCRIPTION

Figure 1:
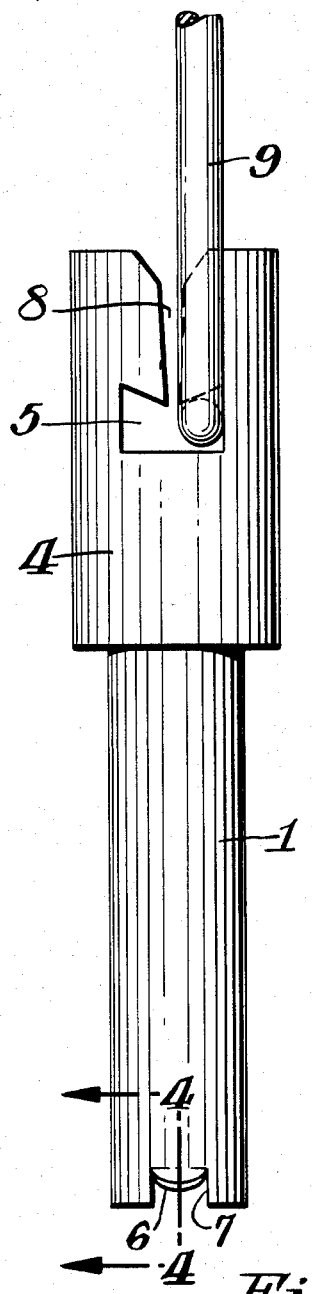
FIG. 1 is a front elevation of a booster/connector assembly of the invention in engagement with a length of LEDC, the package-piercing means being located on the booster shell.

The initiation assembly of the invention is used to initiate explosive charges which are incapable of being initiated reliably by the side output of an adjacent low-energy detonating cord (LEDC), e.g., a cord having an explosive core loading of only about 0.02 to 2 grams per meter. Use of such cords in surface seismic assemblies solves the fire hazard problem associated with the use of high energy cords. The seismic explosive may be an explosive of the dynamite type, or other granular composition, or, preferably, of the gel- or slurry-type, e.g., as described in U.S. Pat. No. 3,431,155, or of the emulsion type, e.g., as described in U.S. Pat. No. 4,287,010. A typical system in which the assembly finds use is one in which a number of bagged or cartridged explosive charges are initiated by a common length of LEDC, e.g., the cord described in U.S. Pat. No. 4,232,606. In such a system, the length of LEDC is attached to the initiators in the initiator/connector assemblies, and the latter puncture the explosive bags and are embedded in the charges.

The initiator portion of the assembly can be a percussion-actuated detonator, or an explosive booster. The detonator preferably is one which is rendered percussion-actuatable by means of a percussion-sensitive primer charge held in a metal primer shell which closes the actuation end of the metal detonator shell. Detonators of this type are described, for example, in U.S. Pat. No. 3,709,149 and in U.S. Pat. No. 4,429,632. The actuation end of the booster is an integrally closed end of a preferably metal shell containing an explosive charge which is percussion-sensitive at least at said end. For example, the booster explosive charge can be a two-component charge consisting of a more-sensitive explosive such as lead azide adjacent the actuation end of the booster shell, topped by a less-sensitive explosive such as cap-grade pentaerythritol tetranitrate (PETN) or cyclotrimethylenetrinitramine (RDX). On the other hand, the booster charge can be an all-PETN or —RDX charge, either of the more-sensitive superfine type or cap-grade, depending on the explosive core loading of the LEDC to be used to initiate the booster. It is also possible to use the superfine explosive adjacent the actuation end, with cap-grade superimposed on it. Examples of booster charges suitable with different core loadings are given in U.S. Pat. No. 4,248,152, the disclosure of which is incorporated herein by reference. It will be readily understood that the specific booster explosive(s) used and the amount thereof, or the size of a detonator's primer charge, will depend on the side-output and wall structure of the low-energy detonating cord to be used as the source of percussion, as well as on the way the cord is positioned adjacent the booster shell or the detonator's primer shell. For example, the cord arrays described in U.S. Pat. no. 4,426,933 may require smaller or less-sensitive percussion-sensitive charges, and are especially adapted to be used with primers in percussion-actuated detonators. It will also be understood that the booster explosive(s) and the amount thereof, or the size of a detonator's base charge, will also be governed by the degree of sensitivity of the explosive charge to be initiated with the present assembly.

When the initiator is a booster, as is shown in FIG. 1, for example, the booster shell preferably has sufficient length that the plug needed for the sealing of the booster charge in the shell, e.g., a preferably plastic capsule or sphere of the required size, becomes seated at a location intermediate the ends of the booster shell, leaving the booster shell with one open end whose surface is suitably configured (e.g., jagged) to adapt it to pierce a frangible package of explosive. The actuation end of this shell then can be seated in the bore of a tubular end-sleeve provided with means for attaching a length of LEDC transversely thereto, e.g., the end-sleeve shown in FIG. 3 or 6. It has been found that when the jagged end surface of the booster shell in this initiator/connector assembly pierces a cartridge of water gel explosive and the assembly is pushed into the explosive so as to become embedded therein, upon detonation of the attached LEDC the cartridged explosive detonates reliably despite any air gap which may form in the booster shell during insertion, and also despite the connector sleeve which intervenes between the booster shell and the surrounding explosive.

Figure 9:
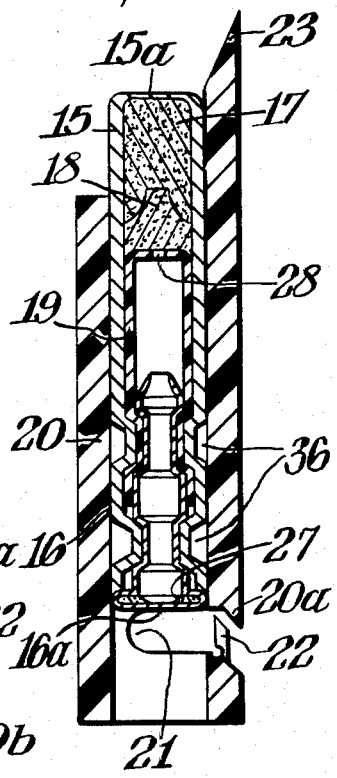
FIGS. 9 and 10 are longitudinal cross-sections of other detonator/connector assemblies of the invention wherein the connector body carries the package-piercing means.
Figure 10:
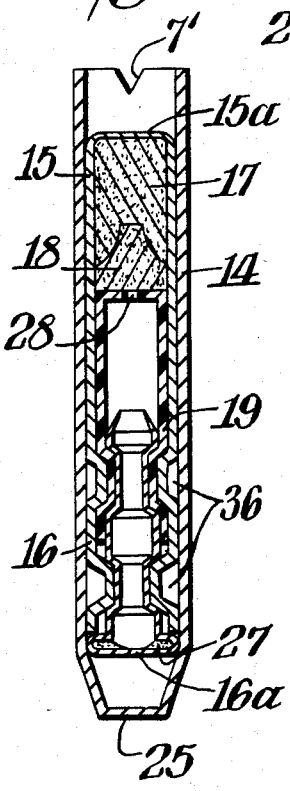
Figure 11:
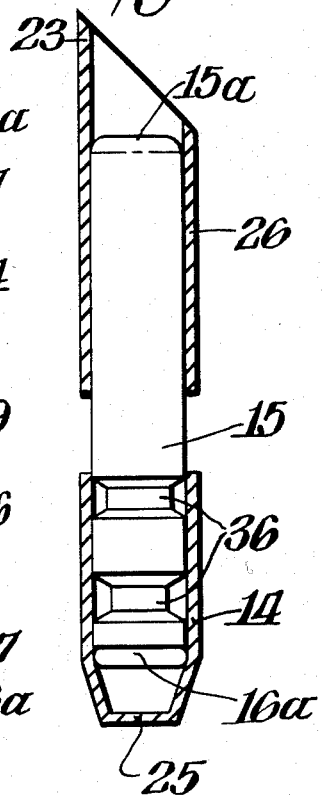
FIG. 11 is a side elevation in partial cross-section of a detonator/connector assembly having a package-piercing means on a special end-sleeve.

In the booster/connector assembly described above, the integrally closed actuation end of the booster shell and the cord connector are at the trailing or back end, and the shell's package-piercing surface is at the leading or forward end, of the assembly in relationship to the direction of its insertion into the frangible explosive package. On the other hand, when the initiator is a detonator, as is shown in FIGS. 9 and 10, for example, the primer end of the detonator is at the trailing end of the assembly, and the detonator shell is integrally closed at the forward end. Consequently, in a detonator/connector assembly the package-piercing means needed at the forward end is more conveniently located on the connector body as is shown in FIGS. 7–10 and 13–15, or on an end-sleeve fitted over the base-charge end of the detonator at the assembly's forward end (FIG. 11).

Turning to FIGS. 1 through 4, 1 is a metal shell having an integrally closed end 1*a* and an open end 1*b*. Shell 1 contains a two-component charge of granular detonating explosive and is thereby adapted to function as a booster. Component 2*a* is a percussion-sensitive composition, and component 2*b* is the main booster explosive, e.g., PETN or RDX. Charge components 2*a* and 2*b* are held in place in shell 1 by pressing, separately or jointly, with a plastic plug 3 in the nature of a capsule fitted snugly within shell 1 against component 2*b*. At its open end 1*b*, two opposing notches 7, 7′ are formed in the end of shell 1 by cutting tabs 6, 6′ in the shell wall and folding them inward toward the shell's axis.

One end of booster shell 1, i.e., the actuation end containing charge 2a/2b, is snugly seated within the bore of plastic tube 4, which forms a tubular end-sleeve on shell 1 as a connecting means for attaching the booster to a length of LEDC and for holding the cord transversely adjacent end 1a. Tube 4 has two diametrically opposed, mutually conformed openings 5, 5' in its wall which together form a transverse slot communicating with the tube's bore for transversely engaging a length of LEDC. The wall of tube 4 contains two diametrically opposed longitudinal slits 8, 8' which lead from openings 5, 5', respectively, to the outer end of tube 4 and lie in a plane that passes through the longitudinal axis of tube 4. Slits 8, 8' together form an axial, constricted transverse passage between the slot formed by openings 5, 5' and the outer end of tube 4. The constricted passage formed by slits 8, 8' allows one or two lengths or sections of LEDC 9 to be pushed into the slot while hindering cord disengagement therefrom.

The edges of each of the openings 5, 5' adjacent slits 8, 8' form acute angles with the adjacent slit on both sides thereof. With this configuration, when the assembly is suspended on cord 9, the latter tends to be diverted from the axis of slits 8, 8' as shown, thereby further assuring the retention of cord 9 in the slot formed by openings 5, 5'.

Figure 5:
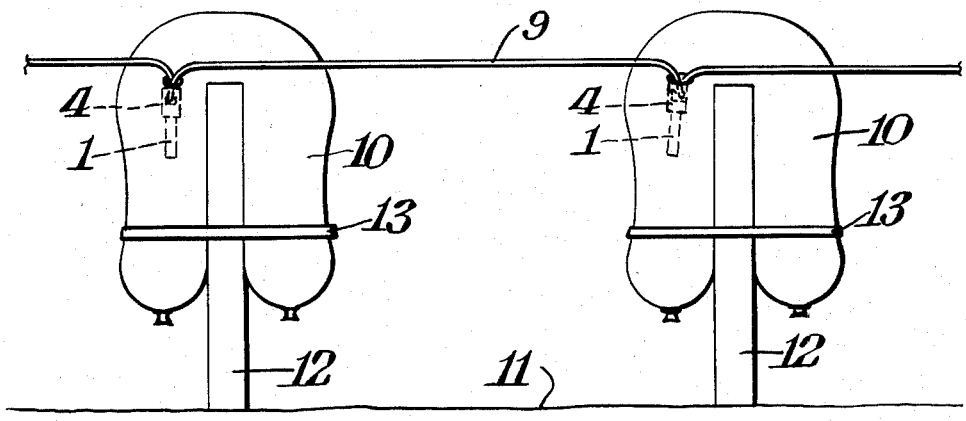
FIG. 5 is a schematic representation of a portion of a seismic prospecting assembly in which an initiation assembly of FIGS. 1 through 4 is embedded in each of a number of elevated flexible packages of explosive.

In the seismic prospecting assembly depicted in part in FIG. 5, a booster/connector assembly of FIGS. 1–4, with cord 9 in position therein as shown, has punctured a flexible cartridge 10 of explosive, e.g., an underfilled film-wrapped "chub" cartridge of water gel explosive, and become embedded therein. To position the initiation assembly, the package-piercing forward end 1b of shell 1 is held against the cartridge and sufficient pressure exerted to pierce the package and embed the initiation assembly therein, with cord 9 emerging from the resulting hole in the cartridge. The booster/connector assembly will be retained in cartridge 10 by virtue of the alignment it adopts after embedment in the explosive, as well as by the possible entrapment of packaging film in slits 8, 8'. Cartridges 10 are suspended above the earth's surface 11 on wooden pegs 12 to which they are affixed by any convenient means, e.g., rubber bands 13, or the LEDC itself, which can be wrapped around the charge and peg. When the charges 10 have been arrayed as desired for the seismic prospecting operation, cord 9 is initiated and the detonation impulse is transmitted to charges 10 via the booster charge 2a/2b in each initiation assembly.

Figure 6:
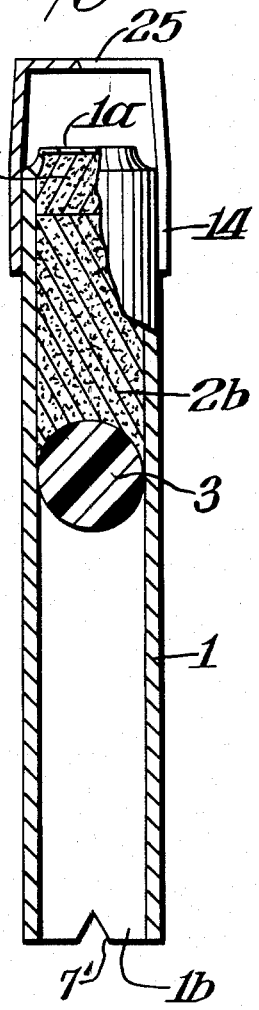
FIG. 6 is a front elevation in partial cross-section of a booster/connector assembly of the invention having a different cord-connecting means from that shown in FIG. 1.
Figure 4:
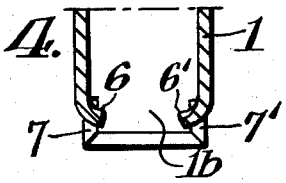
FIG. 4 is a cross-section taken along line 4—4 of FIG. 1.

In the assembly shown in FIG. 6, tube 4 is replaced by metal tube 14, in this case an end-sleeve, which has a loop-like projection 25 diametrically disposed beyond end 1a of shell 1. Projection 25 is in the form of a sharp-cornered U-shaped loop or staple and is adapted to have a length of LEDC threaded therethrough. In the FIG. 6 booster, notch 7' in the package-piercing surface is a V-cut, and plastic plug 3 is a sphere.

In the assembly shown in FIG. 9, the initiator is a detonator having a tubular metal shell 15 integrally closed at one end 15a and closed at the other end by an ignition assembly comprising metal primer shell 16. Shell 16 has an open end an an integrally closed end which peripherally supports on its inner surface a percussion-sensitive primer charge 27 for rim-firing. Shell 16 extends open end first into shell 15 to dispose the outside surface 16a of the integrally closed end adjacent, and across, the end of shell 15.

Starting from end 15a, shell 15 contains, in sequence, base charge 17 of a pressed detonating explosive composition and priming charge 18 of a pressed heat-sensitive detonating explosive composition. Charges 17 and 18 are pressed in place and covered by plastic capsule 19, which is nested within shell 15. Axial orifice 28 in the closed end of capsule 19 allows communication between primer charge 27 and charge 18. Circumferential crimps 36 jointly deform the walls of shells 15 and 16, and shell 15, capsule 19, and shell 16. Detonator shell 15 is snugly seated in the bore of plastic tube 20. Tube 20 has open extremities and, near one of its extremities, a transverse slot 21 communicating with its bore and adapted to engage a length of LEDC. The actuation end of the detonator, i.e., surface 16a of primer shell 16, is adjacent slot 21. Projection 22, formed from the sidewall of tube 20, essentially spans slot 21, acting as a valve to retain the cord to be placed in the slot. Projection 22 is responsive to a force exerted on it to position the cord in slot 21 while resisting disengagement of the cord therefrom by the overhanging portion 20a of the wall of tube 20. At the forward end of the FIG. 9 assembly, the opposite end surface of tube 20 is tapered so that it forms a package-piercing spike 23, which protrudes beyond end 15a of detonator shell 15.

Figure 2:
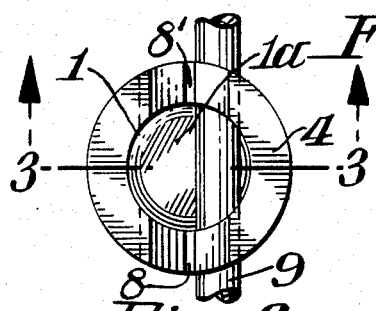
FIG. 2 is a top plan view, and FIG. 3 a longitudinal cross-section, of the assembly of FIG. 1.
Figure 12:
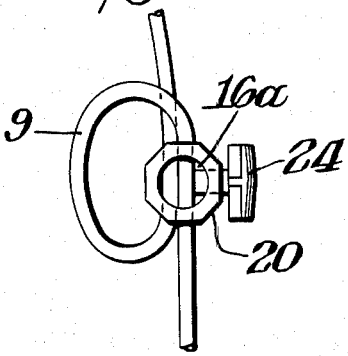
FIGS. 12 and 13 are a top plan view and a side elevation, respectively, of a detonator/connector assembly of the invention affixed to a length of LEDC which is looped so as to position two segments of cord adjacent the actuation end of the detonator.
Figure 13:
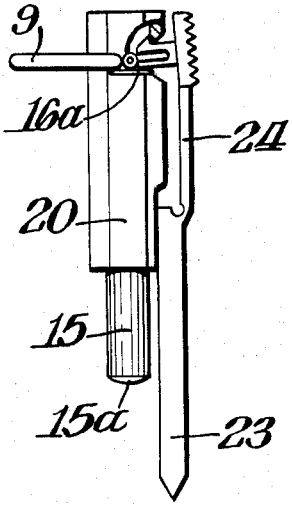

The connector shown in FIGS. 12 and 13 is essentially the one shown in FIG. 2 of U.S. Pat. No. 4,299,167, and, like the one shown in FIG. 8 herein, comprises a plastic tube 20 containing a transverse slot near one end. The slot engages a length of LEDC 9 looped as shown in FIG. 12. Detonator shell 15 is seated in the bore of tube 20 with its base-charge portion outside the tube. Surface 16a of shell 16 is adjacent the transverse slot which holds the looped LEDC. Tube 20 has slotted locking means 24 adapted to form a closure with the transverse slot to lock the looped LEDC in place. Spike 23 is an extension of tube 20, which extends beyond end 15a of the detonator.

Figure 7:
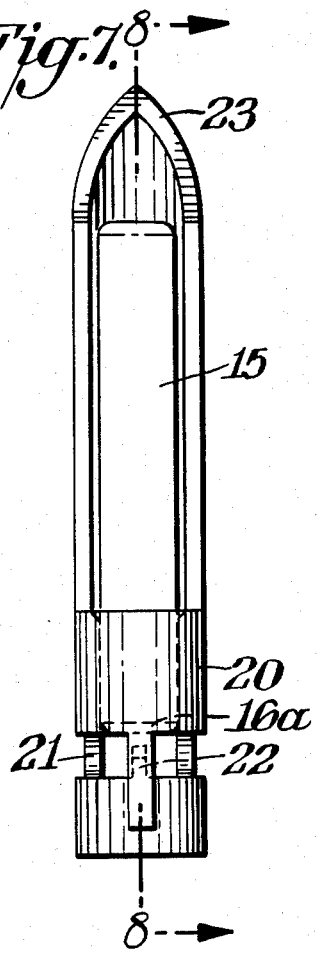
FIG. 7 is a front elevation of a detonator/connector assembly of the invention in which the package-piercing means is located on the connector body.
Figure 8:
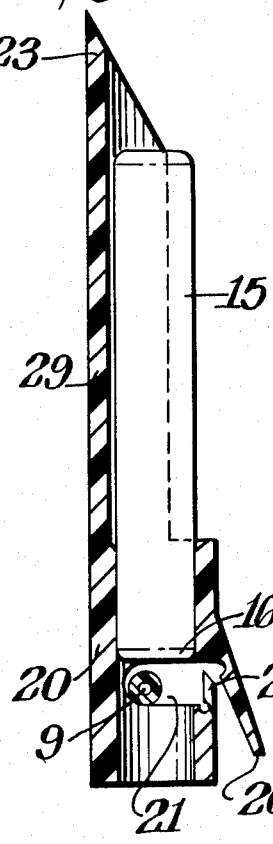
FIG. 8 is a longitudinal cross-section taken along line 8—8 of FIG. 7.

In the assembly shown in FIGS. 7 and 8, plastic tube 20 is an end-sleeve having an integral extension member 29, which has a pointed spike 23 at its forward end. In this embodiment, the portion of the wall of tube 20 which overhangs projection 22 is a barb 20b. Barb 20b is a means of preventing the assembly from being pulled out of an explosive cartridge after insertion, by closing when the assembly is pushed into the explosive cartridge, and opening when tension is applied, thus hindering egress of the assembly. Barb 20b also serves as a means of guiding cord 9 into slot 21, and preventing projection 22 from assuming an open position.

FIGS. 10 and 11 depict embodiments wherein a cord connector of the type shown in FIG. 6 is adapted for use with a detonator. In the assembly shown in FIG. 10, metal tube 14 fits around the entire detonator shell and has a protruding free end surface containing package-piercing notches 7, 7'.

The assembly shown in FIG. 11 has metal tube 14 in the form of a first end-sleeve for the cord connection, and a second end-sleeve 26 which has an end surface that is tapered so as to form a package-piercing spike 23 protruding beyond end 15a of detonator shell 15.

Figure 14:
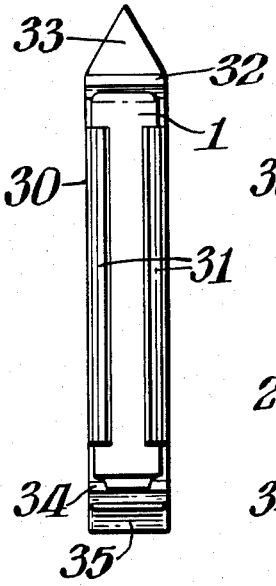
FIGS. 14 and 15 are a front elevation and a side elevation in partial cross-section, respectively, of a booster/-connector assembly wherein the connector is a split tube having a package-piercing means at one end.
Figure 15:
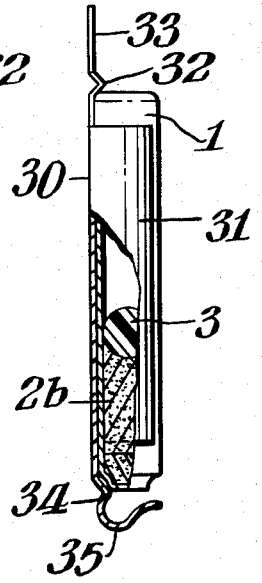

In FIGS. 14 and 15, the cord-connecting means is an open-ended, longitudinally split, metal tube 30, which fits around booster shell 1 for about three-fourths of the shell's length. At one end, split tube 30 has triangular flat extension member 33, which is a package-piercing means. At the other end, tube 30 has a clip- or loop-member 35, which acts like a spring and forms a transverse channel or slot for receiving and retaining a length of LEDC. The spring action of tube 30 causes it to hold its proper position with respect to shell 1. Two notches or crimps 32 and 34 keep shell 1 from sliding longitudinally with respect to tube 30.

Proper functioning of the initiator assembly of the invention in a seismic prospecting operation such as the one shown in FIG. 5 requires that the LEDC retain its position adjacent the initiator's actuation end, and the initiator remain embedded in the packaged explosive prior to initiation of detonation. Therefore, any cord-connecting tube or sleeve having an open cord slot is provided with cord-retainment means adjacent the slot, e.g., the constricted passage and slot configuration per se in the connector shown in FIGS. 1–4, the projection 22 and overhang 20*a* or 20*b* in the connectors shown in FIGS. 8 and 9, and slotted locking means 24 in FIG. 13. Regarding retainment of the initiator in the package, the alignment adopted by the initiator/connector assembly after insertion may itself cause the assembly to remain in place. Also, with the assembly shown in FIGS. 1–4, a packaging material of plastic film may become gathered in the constricted passage formed by slits 8, 8', thereby causing the assembly to be retained within the cartridge. In certain instances, it may be desirable to provide a projection such as 20*a* or 20*b* shown in FIGS. 9 and 8, respectively, at the trailing end of the initiator/-connector assembly.

The seismic explosive package is frangible, i.e., it can readily be pierced or perforated by a sharp or jagged surface such as a notched or pointed metal or plastic surface. While packaging materials such as paper and metal foil may be employed, usually a plastic film, e.g., a polyolefin, will be used. An underfilled film cartridge, e.g., of water-bearing explosive, is a preferred surface seismic charge, for ease of mounting and draping over posts. With such a cartridge, maximum effectiveness is required of the package-piercing means.

EXAMPLE

Figure 3:
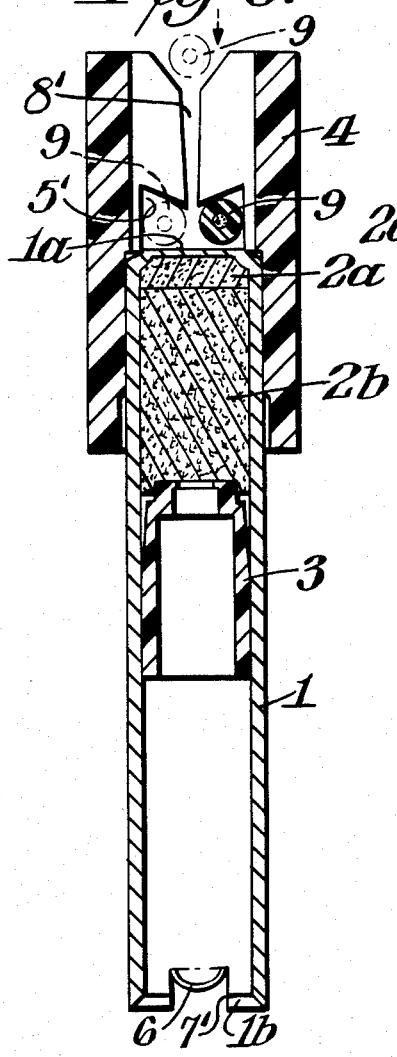

Referring to the assembly shown in FIG. 3, shell 1, made of Type 5052 aluminum alloy, was 41.4 mm long and had an internal diameter of 6.5 mm and a wall thickness of 0.4 mm. Closed end 1*a* of shell 1 was 0.1 mm thick. Charge 2*a* was 0.17 gram of lead azide. Charge 2*b* was 0.51 gram of PETN, which had been placed in shell 1 and pressed therein at 1300 Newtons with a flat press pin. Plastic capsule 3, made of high-density polyethylene, was 10.7 mm long and had an outer diameter of 6.5 mm and a wall thickness of 0.8 mm. Notches 7,7' were 3 mm wide by 3 mm deep.

Cord 9 was the cord described in Example 1 of U.S. Pat. No. 4,232,606. It had a continuous solid core of a deformable bonded detonating explosive composition consisting of a mixture of 75% superfine PETN, 21% acetyl tributyl citrate, and 4% nitrocellulose prepared by the procedure described in U.S. Pat. No. 2,992,087. The superfine PETN was of the type which contained dispersed microholes prepared by the method described in U.S. Pat. No. 3,754,061, and had an average particle size of less than 15 microns, with all particles smaller than 44 microns. Core-reinforcing filaments derived from six 1000-denier strands of polyethylene terephthalate yarn were uniformly distributed on the periphery of the explosive core. The core and filaments were enclosed in a 0.9-mm-thick low-density polyethylene sheath. The diameter of the core was 0.8 mm, and the cord had an overall diameter of 2.5 mm. The PETN loading in the core was 0.53 g/m.

Cord-connecting tube 4 was made of polypropylene. It had an overall length of 21.8 m, an average wall thickness of 1.5 mm, and an average bore diameter of 6.9 mm. Slits 8,8' were 1.0 mm wide at their widest point, narrowing down to 0.7 mm adjacent openings 5,5'. Openings 5,5' were 4.6 mm wide. Their height was 2.5 mm on the tube axis, and 3.8 mm at the extreme sides.

Shell 1 was seated in tube 4 with a force of 110 Newtons.

Cord 9 was bent into a loop, which was pushed into slits 8,8'. The cord automatically wedged itself in the sides of openings 5,5' (off-axis), thereby preventing the loop from sliding out through slits 8,8'.

The assembly was pushed into a Valeron (biaxially oriented polyethylene film) cartridge filled with the water gel explosive described in U.S. Pat. No. 3,431,155, which explosive had been cooled to −31° C. Notches 7,7' on the end of booster shell 1 readily penetrated the film, and the entire assembly was easily inserted into the water gel and aligned therein so as to preclude accidental pull-out. Cord 9 was initiated by abutting an electric detonator to one of the cord's free ends. Detonation of the cord caused the booster to detonate, which in turn detonated the cartridged water gel.

As has been shown above, the initiator in the initiator/connector assembly of the invention functions satisfactorily even when the connector body is present between the initiator shell and the surrounding explosive in the frangible cartridge. The intervening wall of a plastic connector may be as thick as about 3.2 mm, although practical plastic thicknesses generally will be about from 0.5 to 2.5 mm. Metal connecting tubes whose wall surrounds the initiator composition generally will be in the range of about from 0.1 to 0.5 mm thick. However, inasmuch as maximum reliability of initiation is achieved with minimum intervention of inert material between the booster charge or detonator base charge and the explosive to be initiated thereby, it is preferred that an intervening connector tube wall be as thin as possible or contain one or more holes for venting, or that all or part of the booster charge or base charge portion of the initiator shell be directly exposed to the surrounding explosive.

We claim:

1. An assembly for initiating a detonating explosive charge in a frangible package by means of a length of low-energy detonating cord (LEDC) comprising:

(a) a percussion-actuated explosive initiator comprising a tubular shell containing a percussion-sensitive composition at one end thereof, the actuation end;

(b) connecting means fitted around at least a portion of said initiator shell for the attachment of said initiator to a length of LEDC, said connecting means being adapted to hold said cord transversely adjacent the actuation end of said initiator shell; and (c) a jagged surface at the forward end of said assembly opposite the trailing end at which said shell's actuation end is located, said jagged surface being adapted to pierce a frangible package containing a detonating explosive and enabling said initiator to be embedded in said explosive forward end first.

2. An assembly of claim 1 including means for inhibiting the egress of said initiator from said package.

3. An assembly of claim 1 wherein said initiator shell is a metal detonator shell integrally closed at one end and closed at its actuation end by a partially empty, shorter tubular metal primer shell having an open end and supporting a percussion-sensitive primer charge adjacent the inside surface of an integrally closed end, said primer shell extending open end first into said detonator shell to dispose the outside surface of its primer charge end adjacent, and across, the end of said detonator shell, said detonator shell containing, in sequence from its integrally closed end, (1) a base charge of granular high-velocity detonating explosive and (2) a priming charge of a heat-sensitive detonating explosive, said detonator shell being snugly seated in the bore of a connecting tube having a loop-like projection diametrically disposed beyond one end thereof so that the outside surface of the primer charge end of said detonator shell faces said loop-like projection, said projection being adapted to have a length of LEDC threaded therethrough, and the opposite end of said tube being a protruding end surface which is jagged for package-piercing purposes.

4. An assembly of claim 1 wherein (a) said connecting means is a metal tube open at both ends and having a split wall from one end to the other, said tube fitting around said initiator shell and being held thereon by spring action, said metal tube being provided at one end with a spring-acting clip-like projection which forms a transverse slot adapted to engage said length of LEDC, the actuation end of said initiator shell being held in position adjacent said slot by a pair of notches in the wall of said metal tube; and (b) said jagged surface is a suitably configured surface on a projection emerging from the opposite end of said metal tube.

5. An assembly of claim 1 wherein (a) said connecting means is a tube having, at one end thereof, a transverse slot communicating with its bore and adapted to engage said length of LEDC, said initiator shell being snugly seated in said bore so that its actuation end is adjacent said transverse slot, and said connecting tube being provided with retaining means adjacent said transverse slot for preventing the disengagement of said cord therefrom after allowing the cord to be pushed into place therein; and (b) said jagged surface is a suitably configured opposite end surface of said connecting tube protruding beyond the opposite end of said initiator shell.

6. An assembly of claim 5 wherein said connecting tube is made of plastic and the end surface thereof opposite said slot-containing end is tapered so as to form a spike.

7. An assembly of claim 1 wherein (a) said connecting means is a tube having, at one end thereof, a transverse slot communicating with its bore and adapted to engage said length of LEDC, said initiator shell being snugly seated in said bore so that its actuation end is adjacent said transverse slot and its opposite, forward end protrudes beyond the opposite, forward end of said connecting tube, said connecting tube being provided with retaining means adjacent said transverse slot for preventing the disengagement of said cord therefrom after allowing the cord to be pushed into place therein; and (b) said jagged surface is a suitably configured surface on an extension member integral with, and emerging from the forward end of, said connecting tube and protruding beyond the forward end of said initiator shell.

8. An assembly of claim 7 wherein said connecting tube is made of plastic and said extension member is a pointed spike.

9. An assembly of claim 5 or claim 7 wherein said connecting tube is made of plastic, said transverse slot is a recessed channel in the tube wall, and said retaining means adjacent said transverse slot is a slot-spanning lip formed from the sidewall of said connecting tube.

10. An assembly of claim 9 wherein said lip is responsive to a force directed on it normal to, and toward, the tube axis and resistant to an opposite force.

11. An assembly of claim 5 or claim 7 wherein said connecting tube is made of plastic and said transverse slot is formed from two diametrically opposed, mutually conformed openings in the tube wall, said retaining means adjacent said transverse slot being an axial, constricted transverse passage between said slot and said tube end, said constricted passage being formed from two diametrically opposed longitudinal slits, one leading from each of said openings to the outer end of said tube, said slits lying in a plane that passes through the longitudinal axis of said tube, said passage being adapted to allow a length of LEDC to be pushed into, while hindering its disengagement from, said slot, and said openings being so configured that a length of LEDC transversely engaged in said slot is diverted from the axis of said constricted passage.

12. An assembly of claim 11 wherein each of said openings has two separated edge surfaces each of which is joined to one of the opposing surfaces of one of said slits and forms an acute angle therewith.

13. An assembly of claim 1 wherein (a) said initiator is a booster whose metal shell has an integrally closed actuation end, an internal plug for sealing the explosive charge therein, an open end surface which is jagged to adapt it to pierce a frangible package, and (b) said connecting means is a tubular end-sleeve having a bore within which the actuation end of said booster shell is seated.

14. An assembly of claim 13 wherein said tubular end-sleeve has a loop-like projection diametrically disposed beyond the actuation end of said booster shell, said projection being adapted to have a length of LEDC threaded therethrough.

15. An assembly of claim 13 wherein said tubular end-sleeve has a transverse slot communicating with said bore and adapted to engage said length of LEDC, said booster shell, in part, being snugly seated in said bore so that its actuation end is adjacent said transverse slot, and said end-sleeve being provided with retaining means adjacent said transverse slot for preventing the disengagement of said cord therefrom after allowing the cord to be pushed into place therein.

16. An assembly of claim 15 wherein said connecting tube is made of plastic, said transverse slot is a recessed channel in the tube wall, and said retaining means adjacent said transverse slot is a slot-spanning lip formed from the sidewall of said connecting tube.

17. An assembly of claim 16 wherein said lip is responsive to a force directed on it normal to, and toward, the tube axis and resistant to an opposite force.

18. An assembly of claim 15 wherein said end-sleeve is made of plastic and said transverse slot is formed from two diametrically opposed, mutually conformed openings in the sleeve wall, said retaining means adjacent said transverse slot being an axial, constricted transverse passage between said slot and said sleeve end, said constricted passage being formed from two diametrically opposed longitudinal slits, one leading from each of said openings to the outer end of said sleeve, said slits lying in a plane that passes through the longitudinal axis of said sleeve, said passage being adapted to allow a length of LEDC to be pushed into, while hindering its disengagement from, said slot, and said openings being so configured that a length of LEDC transversely engaged in said slot is diverted from the axis of said constricted passage.

19. An assembly of claim 18 wherein each of said openings has two separated edge surfaces each of which is joined to one of the opposing surfaces of one of said slits and forms an acute angle therewith.

20. An assembly of claim 1 wherein (a) said initiator shell is a metal detonator shell integrally closed at one end and closed at its actuation end by a partially empty, shorter tubular metal primer shell having an open end and supporting a percussion-sensitive primer charge adjacent the inside surface of an integrally closed end, said primer shell extending open end first into said detonator shell to dispose the outside surface of its primer charge end adjacent, and across, the end of said detonator shell, said detonator shell containing, in sequence from its integrally closed end, (1) a base charge of granular high-velocity detonating explosive and (2) a priming charge of a heat-sensitive detonating explosive, and (b) said connecting means is a first tubular end-sleeve fitted over the actuation end of said detonator shell, and said jagged surface is a suitably configured end surface of a second tubular end-sleeve fitted snugly over, and protruding beyond, the opposite end of said detonator shell.

21. An assembly of claim 20 wherein said first tubular end-sleeve is made of plastic and has a transverse slot communicating with its bore and adapted to engage a length of LEDC, said first end-sleeve being fitted over the actuation end of said detonator shell so that the detonator shell's actuation end is adjacent said transverse slot, and said first end-sleeve being provided with retaining means adjacent said transverse slot for preventing the disengagement of said cord therefrom after allowing the cord to be pushed into place therein.

22. An assembly of claim 20 wherein said first tubular end-sleeve is made of metal and has a loop-like projection diametrically disposed beyond the actuation end of said detonator shell, said projection being adapted to have said length of LEDC threaded therethrough.

23. An assembly of claim 21 or claim 22 wherein said second end-sleeve is made of metal and said configured end surface is notched.

24. A cord/initiator connector comprising a plastic tube having two diametrically opposed, mutually conformed openings in its wall which together form a transverse slot communicating with the tube's bore and adapted to transversely engage a length of LEDC, the wall of said tube containing two diametrically opposed longitudinal slits, one leading from each of said openings to the outer end of said tube, said slits lying in a plane that passes through the longitudinal axis of said tube and together forming an axial, constricted transverse passage between said cord-engaging slot and said tube end, said passage being adapted to allow a length of LEDC to be pushed into, while hindering its disengagement from, said slot, and said openings being so configured that a length of LEDC transversely engaged in said slot is diverted from the axis of said constricted passage.

25. A cord/initiator connector of claim 24 wherein each of said openings has two separated edge surfaces each of which is joined to one of the opposing surfaces of one of said slits and forms an acute angle therewith.

26. A cord/initiator connector comprising a plastic tube having, at one end thereof, a transverse slot communicating with its bore and adapted to engage a length of LEDC, and its opposite end surface being tapered to form a package-piercing spike of sufficient length to protrude beyond the end of an initiator shell which said tube is adapted to hold, said tube being provided with retaining means adjacent said transverse slot for preventing the disengagement of a length of LEDC therefrom.

27. A cord/initiator connector comprising a plastic tube having, at one end thereof, a transverse slot communicating with its bore and adapted to engage a length of LEDC, and a spike-like extension member integral with, and emerging from the opposite end of, said tube, said tube also being provided with retaining means adjacent said transverse slot for preventing the disengagement of a length of LEDC therefrom.

28. An explosive booster comprising a metal shell integrally closed at one end thereof, the actuation end, and containing a percussion-sensitive composition at said actuation end and an internal plug for the retainment of an explosive charge therein, said shell having an open end surface opposite its actuation end which is jagged to adapt it to pierce a frangible package.

29. An explosive booster of claim 28 wherein said booster shell contains, in sequence from said integrally closed end, a percussion-sensitive initiation charge and a booster charge of granular high-velocity detonating explosive.

30. An explosive booster of claim 29 wherein said initiation charge is lead azide and said booster charge is pentaerythritol tetranitrate.

31. A seismic prospecting assembly comprising a plurality of detonating explosive charges in frangible packages supported above the ground and, embedded in each of said charges, an initiation assembly comprising (a) a percussion-actuated explosive initiator comprising a tubular shell containing a percussion-sensitive composition at one end thereof, the actuation end, (b) connecting means fitted around at least a portion of said initiator shell for the attachment of said initiator to a length of LEDC, and (c) a jagged surface at the forward end of said assembly opposite the trailing end at which said shell's actuation end is located; said jagged surface having pierced said package whereby said initiator is embedded in said explosive charge forward end first, and said initiation assemblies holding a common length of LEDC transversely adjacent the actuation ends of the initiators therein.

32. An assembly of claim 31 wherein said explosive charges are charges of water-bearing explosive contained in cartridges or bags of plastic film.

33. An assembly of claim 32 wherein said LEDC comprises a continuous solid core of a deformable bonded detonating explosive composition comprising a crystalline high-explosive compound admixed with a binding agent, and a protective plastic sheath enclosing the core.

* * * * *